US006279784B1

(12) United States Patent
O'Neill

(10) Patent No.: US 6,279,784 B1
(45) Date of Patent: Aug. 28, 2001

(54) TRIGGER ACTIVATED PUMP SPRAYER HAVING A COMBINATION DUAL ACTION SPRING AND FLUID CHAMBER

(76) Inventor: Richard K. O'Neill, 1216 Rivera St., Wrightwood, CA (US) 92397

( * ) Notice: Subject to any disclaimer, the term of this patent is extended or adjusted under 35 U.S.C. 154(b) by 0 days.

(21) Appl. No.: 09/407,030

(22) Filed: Sep. 27, 1999

(51) Int. Cl.[7] ..... B65D 37/00
(52) U.S. Cl. ..... 222/207; 222/336
(58) Field of Search ..... 222/207, 383.1, 222/340, 336, 339, 341

(56) References Cited

U.S. PATENT DOCUMENTS 3,749,290 * 7/1973 Micallef ..... 222/385
4,220,264 * 9/1980 Gamadia ..... 222/207
4,260,079 * 4/1981 Cary et al. ..... 222/209
4,336,895 * 6/1982 Aleff ..... 222/207
5,114,052 * 5/1992 Tiramani et al. ..... 222/207
5,476,195 * 12/1995 Oder et al. ..... 222/207
5,518,147 * 5/1996 Peterson et al. ..... 222/153.07

* cited by examiner

*Primary Examiner*—Kevin Shaver
*Assistant Examiner*—Frederick C Nicolas
(74) *Attorney, Agent, or Firm*—Morland C. Fischer

(57) ABSTRACT

A trigger activated pump sprayer to be attached to a fluid filled container so that fluid from the container can be delivered to and sprayed from a nozzle. A one piece combination dual action spring and fluid chamber is housed within a shroud. The combination is manufactured from a resilient rubber material having a spring-like memory and including an expandible spring section integrally connected to and axially aligned with a collapsible fluid chamber section. A trigger that is adapted to rotated within the shroud is coupled to the combination between the expandible spring and collapsible fluid chamber sections thereof. When the trigger is manipulated (i.e. rotated) by a user during a dispensing cycle, the expandable spring section is stretched and the collapsible fluid chamber section is compressed to increase the pressure within the fluid chamber section whereby to break a seal and open a fluid path between the fluid chamber section and the nozzle.

20 Claims, 4 Drawing Sheets

TRIGGER ACTIVATED PUMP SPRAYER HAVING A COMBINATION DUAL ACTION SPRING AND FLUID CHAMBER

BACKGROUND OF THE INVENTION

1. Field of the Invention

This invention relates to a trigger activated pump sprayer to be coupled to a fluid filled container, wherein the sprayer includes a one piece combination dual action spring and fluid chamber having an expandable spring section integrally connected to and cooperating with a collapsible fluid chamber section.

2. Background Art

Pump sprayers that are trigger activated have long been used as a convenient and easy way to gain access to a supply of fluid that is stored within a container to which the sprayer is attached. However, conventional pump sprayers have been characterized by a relatively large number of parts. For example, to insure a reliable reciprocal action of the trigger between stroke cycles, the trigger assembly has typically included a piston located within and movable through a cylinder in cooperation with a metallic return spring. The use of a large number of parts increases the cost of manufacture for the trigger assembly. This increase in cost is often passed down to the consumer. What is more, a trigger assembly characterized by many parts, including a metal return spring, is more likely to fail than a trigger assembly consisting of a few parts, such that the entire trigger assembly may have to be prematurely discarded. In fact, the metal return spring may not always be compatible with the environment.

Accordingly, it is desirable to have available an environmentally friendly pump sprayer that includes a compact trigger assembly that can be manufactured from a reduced number of non-metallic parts, whereby to facilitate the manufacturing process, reduce the manufacturing cost and prolong the life of the sprayer.

SUMMARY OF THE INVENTION

In general terms, a trigger activated pump sprayer is disclosed to be coupled to the neck of a fluid filled container so that fluid from the container can be delivered to and sprayed from a nozzle. The pump sprayer includes a shroud within which is housed a resilient, one piece combination dual action spring and fluid chamber. The combination is molded from a thermo-plastic rubber and includes a collapsible fluid chamber section located above and integrally connected to an expandable spring section. Surrounding the fluid chamber and spring sections of the combination are upper and lower ledges that are arranged in spaced parallel alignment with one another. The trigger is rotatable through the shroud in response to a manual manipulation from a user. The trigger is coupled to the combination spring and fluid chamber by means of a pair of fingers that are located in the space between the upper and lower ledges. Depending downwardly from the collapsible fluid chamber section is a tube socket that is sized to surround and engage a fill tube that communicates with the fluid supply of the container. A tapered valve seat is formed near the top of the tube socket and a ball is seated thereon to form a one way check valve between the collapsible fluid chamber and the fill tube. An elongated elbow runs through the shroud from the nozzle to the combination spring and fluid chamber to support the trigger for rotation. The elbow bends downwardly within the shroud, and a centering post thereof is received through the top of the collapsible fluid chamber section. In the at rest condition of the pump sprayer with the trigger relaxed and no forces being generated, a sealing ring carried at the top of the collapsible fluid chamber section is closed against the centering post of the elbow to prevent fluid communication between the fluid chamber section and the nozzle by way of a fluid channel that extends therebetween.

In operation, the trigger is manipulated (i.e. rotated) by a user to prime the pump sprayer. As the trigger is rotated, the trigger fingers between the upper and lower ledges of the compressible fluid chamber section and expandable spring section are correspondingly rotated to cause the expandable spring section to be stretched and the collapsible fluid chamber section to be compressed. Accordingly, the ball is pushed against its valve seat and the air pressure is increased within the fluid chamber section, whereby the seal between the sealing ring and the centering post of the elbow is broken to open a fluid path by which any air trapped in the fluid chamber section prior to the first use of the sprayer is now expulsed to the atmosphere via the fluid channel and the nozzle. When each priming stroke of the trigger is completed, the original seal between the sealing ring and the centering post is once again established. At the same time, the spring-like memory characteristic of the resilient spring section will cause the combination dual action spring and fluid chamber to automatically return to its at rest configuration and the trigger to be driven back to its at rest position.

During the suction stroke of the trigger and the corresponding rotation of the trigger finger, the ball will be lifted off its valve seat to open a fluid path between the fluid supply of the container and the evacuated fluid chamber section via the fill tube, whereby the fluid chamber will now be filled with fluid. During a subsequent dispensing stroke of the trigger, the increasing fluid pressure within the fluid chamber section as it is compressed will force the ball against its valve seat and break the seal created by the sealing ring to complete the fluid path from the fluid chamber section to the nozzle via the fluid channel so that fluid can be sprayed from the nozzle in the direction in which it is aimed by the user.

DETAILED DESCRIPTION

Figure 1:
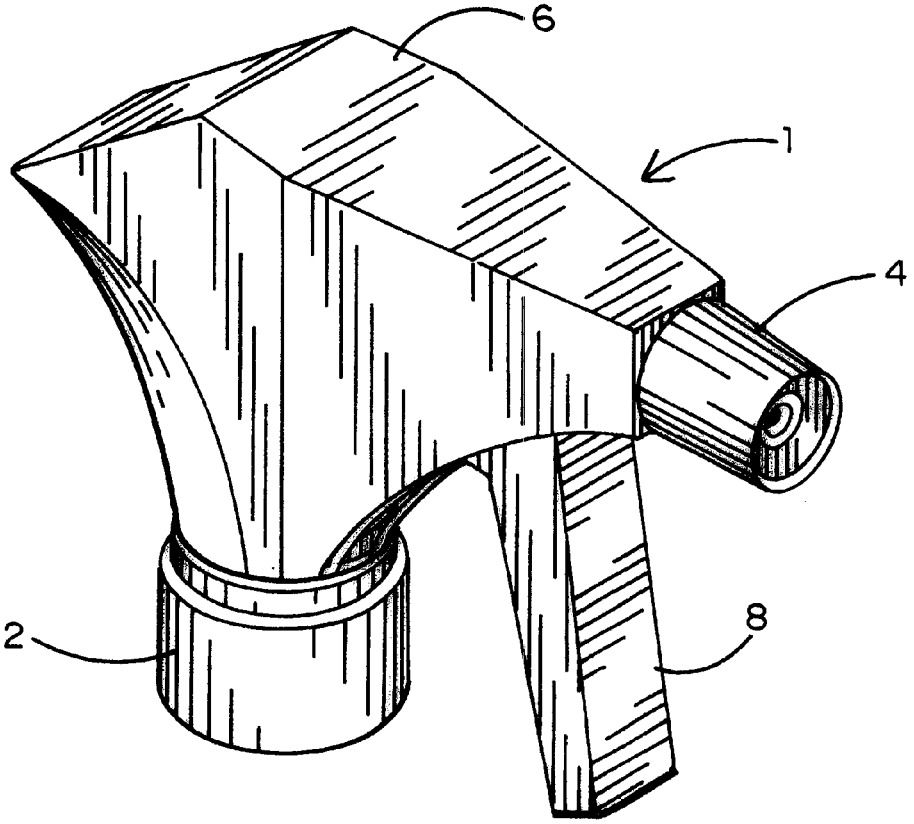
FIG. 1 is a perspective view of a trigger activated pump sprayer having a shroud in which to house the combination dual action spring and fluid chamber which forms the present invention.

A trigger activated pump sprayer 1 having the one piece combination dual action spring and fluid chamber 10 which forms the present invention is initially described while referring to FIG. 1 of the drawings. The pump sprayer is typically manufactured from plastic. A cap closure 2 having internal screw threads is adapted to be removably attached to a correspondingly threaded neck of a fluid filled container (designated 50 in FIGS. 4 and 5). A fill tube (designated 52 in FIGS. 4 and 5) extends into the fluid reservoir of the container 50 so that a supply of fluid from container 50 can be delivered, by means of suction, to the nozzle 4 of pump sprayer 1 by way of the fill tube 52 and the combination spring and fluid chamber 10. The details of the combination 10 will be described in greater detail hereinafter when referring to FIGS. 2 and 3.

A shroud 6 extends between the cap closure 2 and the nozzle 4 of pump sprayer 1 within which the combination spring and fluid chamber 10 of this invention is housed. Projecting outwardly from the shroud 6 of pump sprayer 1 is a trigger 8. As will also be described in greater detail, the trigger 8 depends from a soon to be described elbow (designated 38 in FIGS. 4 and 5) and is adapted to be rotated through the shroud 6 so as to move into contact and cooperate with the combination spring and fluid chamber 10 and thereby control the delivery of fluid from the container 50 to the nozzle 4 of pump sprayer 1.

Figure 3:
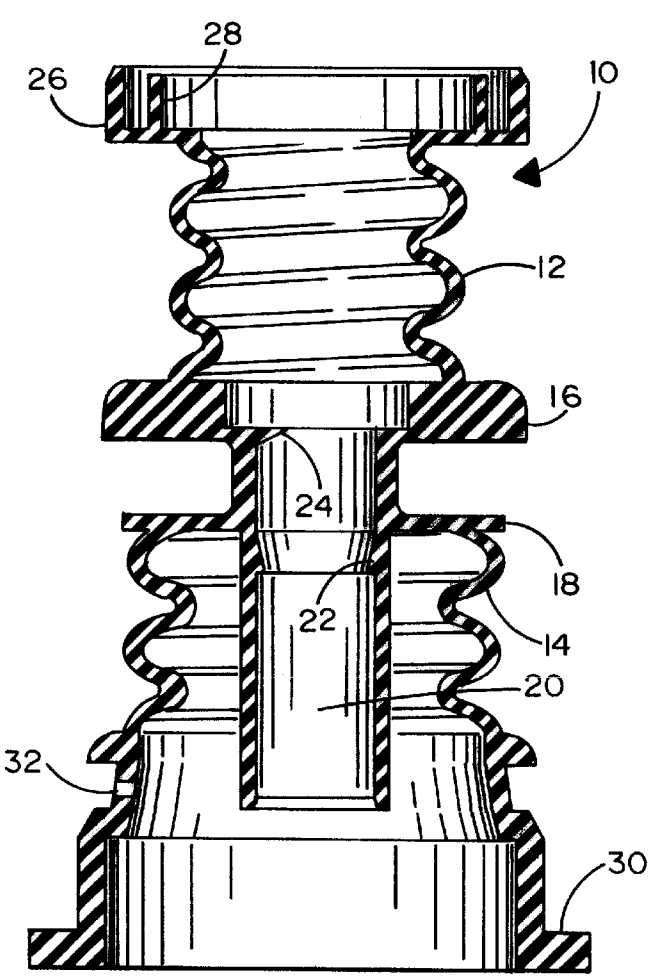
FIG. 3 is a cross section taken along lines 2—2 of FIG. 2.
Figure 2:
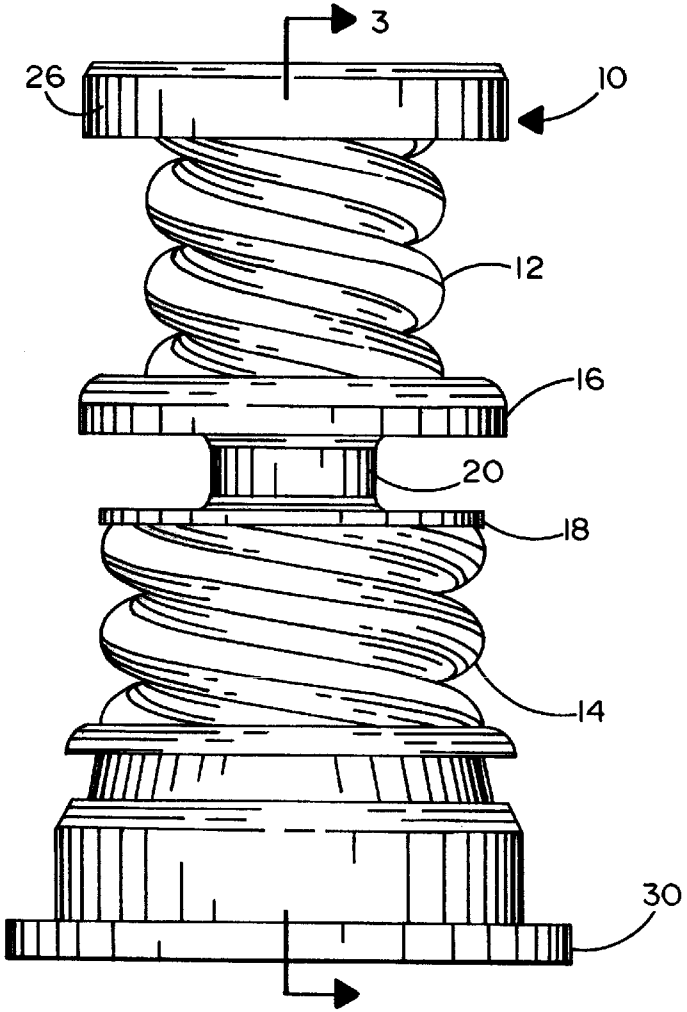
FIG. 2 shows a detailed enlargement of the combination dual action spring and fluid chamber.
Figure 4:
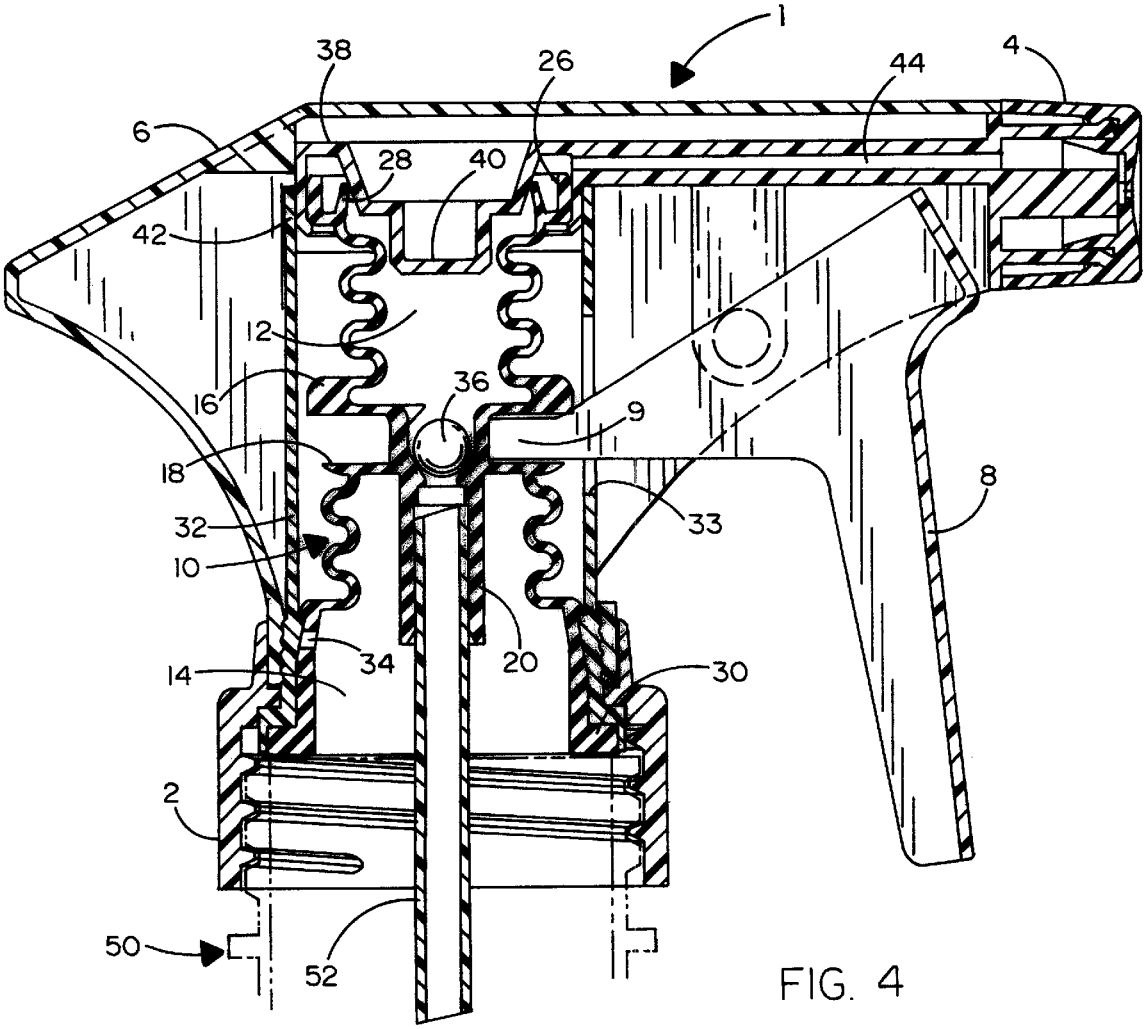
FIG. 4 shows a cross section of the pump sprayer while at rest.
Figure 5:
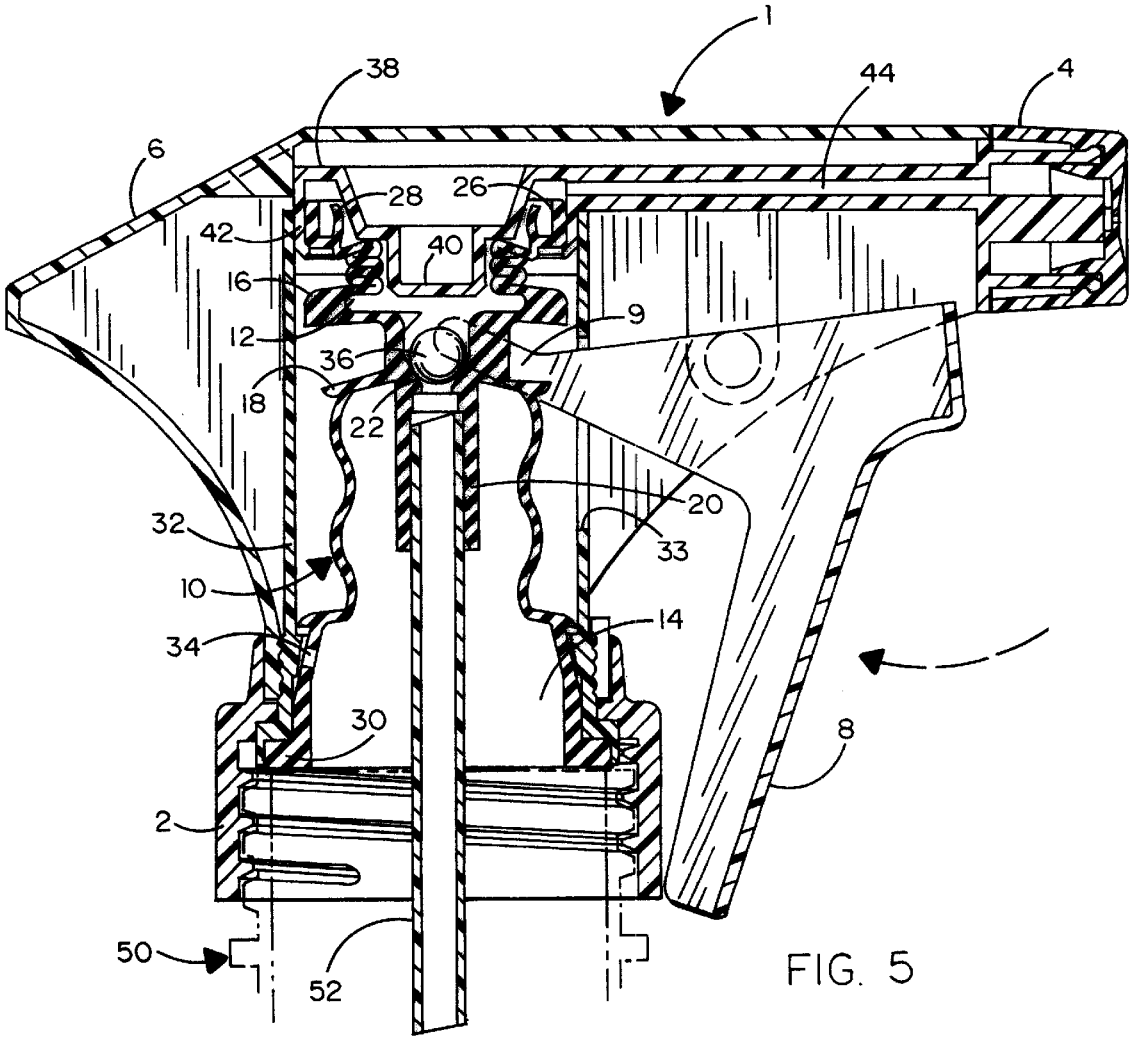
FIG. 5 shows a cross section of the pump sprayer during a dispensing stroke of the trigger for dispensing a fluid.

Turning to FIGS. 2 and 3 of the drawings, details of the one piece combination dual action spring and fluid chamber 10 are now disclosed. The combination 10 includes a first open ended section which forms a collapsible fluid chamber 12 that is axially aligned with and integrally connected to a second open ended section which forms an expandable spring 14. The combination 10 is preferably molded from a resilient thermoplastic rubber (TPR). To facilitate the manufacturing process, each of the axially aligned collapsible fluid chamber and expandable spring sections 12 and 14 of combination 10 is manufactured to have a helical shape. Surrounding the collapsible fluid chamber and expandable spring sections 12 and 14 of combination 10 are upper and lower ledges 16 and 18 which are arranged is spaced parallel alignment with one another. As is best shown in FIGS. 4 and 5, the trigger 8 of pump sprayer 1 is coupled to and cooperates with the combination spring and fluid chamber 10 by means of a fork-shaped actuator having a pair of trigger fingers 9 (only one of which is shown) located at the space between the upper and lower ledges 16 and 18 of the collapsible fluid chamber section 12 and the expandable spring section 14.

As is best shown in FIG. 3, each of the collapsible fluid chamber and expandable spring sections 12 and 14 of combination 10 has a hollow cross section, whereby the spring section 14 is adapted to expand and store energy, and the fluid chamber section 12 is adapted to be collapsed to compress air or any fluid therewithin in response to the movement of each of the pair of fingers 9 of trigger 8 between the upper and lower ledges 16 and 18. A hollow tube socket 20 runs from the bottom of the fluid chamber section 12 through the spring section 14 of combination 10. Tube socket 20 is sized to surround and frictionally engage the fill tube 52 so that fluid can be delivered from the container 50 to the nozzle 4 of pump sprayer 1 by way of the fluid chamber section 12 of combination 10.

The tube socket 20 has a tapered (i.e. relatively narrow) throat 22 located immediately above the interface of the tube socket 20 with the fill tube 52. In the assembled configuration of FIGS. 4 and 5, a plastic ball (designated 36) is seated upon the tapered throat 22 to form a one way check valve. Projecting inwardly from the top of the tube socket 20 and spaced above the tapered throat 22 is a ball limiting tab 24. The tab 24 functions to prevent the ball 36 from floating off its seat (i.e. throat 22) and moving upwardly into the fluid chamber section 12 during the suction stroke of the trigger 8 when fluid is being delivered from the fluid filled container 50 through the fill tube 52 at which time the ball 36 will be pushed off its seat.

To enable the combination dual action spring and fluid chamber 10 to be retained within the shroud 6 of pump sprayer 1, a wide upper rim 26 is formed atop the fluid chamber section 12. The upper rim 26 carries a sealing ring 28 which, in the assembled configuration of FIGS. 4 and 5, communicates with the shroud 6 to control the flow of fluid from the fluid chamber section 12 to the nozzle 4 of pump sprayer 1.

In order to tightly seal the combination dual action spring and fluid chamber 10 against a container to which the closure 2 of pump sprayer 1 is attached, a relatively wide lower base 30 is formed below the expandable spring section 14. The lower base 30 forms a gasket surface around the neck of the fluid filled container 50 so as to avoid the need for a separate gasket as is otherwise common with conventional pump sprayers. To prevent a dislocation of and hold the combination spring and fluid chamber 10 against the container 50, a cylindrical closure retainer 32 surround the combination 10. The bottom of the closure retainer 32 is sandwiched between the closure 2 that is attached (i.e. screwed down) to the neck of container 50 and the lower base 30 of the combination 10. A window 33 is formed through one side of closure retainer 32 to accommodate the fingers 9 of trigger 8. A vent hole 34 communicates with the hollow interior of the expandable spring section 14 through the body of combination 10.

The operation of the combination dual action spring and fluid container 10 of this invention is described while referring to FIGS. 4 and 5 of the drawings. FIG. 4 shows the combination spring and fluid container 10 at rest when the trigger 8 is relaxed and there is no fluid within the fill tube 52 to be delivered to the nozzle 4 of the pump sprayer 1. In the at rest condition, with no suction forces being generated, the plastic ball 36 is loosely seated above the fill tube 52 to block fluid communication between the fluid chamber section 12 of combination 10 and the fluid filled container 50. Moreover, each of the collapsible fluid chamber and expandable spring sections 12 and 14 of combination 10 are also relaxed (i.e. no compressive forces are applied to fluid chamber section 12 and no expansive forces are applied to spring section 14). In addition, the vent hole 34 that communicates with the hollow interior of spring section 14 is closed against the closure retainer 32.

It is important to note that prior to the manipulation of the trigger 8, the sealing ring 28 carried by the upper rim 26 of combination 10 performs a sealing function. More particularly, in order to reliably position and align the combination dual action spring and fluid chamber 10 within the shroud 6 of sprayer 1, the shroud 6 is provided with an elongated elbow 3 8 that extends from the top of the fluid chamber section 12 to the nozzle 4. One end of elbow 38 supports the trigger 8 for rotation, and the opposite end of the elbow bends downwardly, whereby a centering post 40 thereof is received through the open top end of the fluid chamber section 12. To preserve the relaxed shape of the fluid chamber section 12 while at rest, the elbow 38 is also provided with a lip 42 that surrounds and engages the upper rim 26. With the centering post 40 of elbow 38 received within the fluid chamber section 12 of combination 10, the sealing ring 28 of the upper rim 26 will contact and seal against the centering post 40, whereby to close the fluid path from the fluid chamber section 12 to the nozzle 4 via a fluid channel 44 that runs therebetween.

In FIG. 5, the trigger is now manipulated by a user. During the initial priming strokes, the trigger 8 is rotated in the direction of the reference arrow shown in FIG. 5. The rotation of trigger 8 is transferred from each trigger finger 9 to the combination spring and fluid chamber 10. As was previously described, each of a pair of trigger fingers 9 of a fork-shaped trigger activator is located between the upper and lower ledges 16 and 18 of the fluid chamber 12 and expandable spring section 14. Therefore, as the trigger 8 is rotated, each trigger finger 9 is correspondingly rotated upwardly through the window 33 of closure retainer 32, and a push-full effect is imparted to the combination spring and fluid chamber 10, such that the expandable spring section 12 is compressed and collapsed. At the same time, the vent hole 34 is opened to communicate with the hollow interior of the expanded spring section 14. Therefore, an air path is established from the atmosphere to the interior of the fluid container 50 via vent hole 34 to avoid a vacuum within the container.

The volume of fluid chamber section 12 is reduced near the end of each priming stroke in response to the manipulation of trigger 8 whereby the air pressure within fluid chamber section 12 is increased. Accordingly, the ball 36 is forced against its valve seat 22, and the sealing ring 28 is moved out of contact with the centering post 40 of the elbow 38 so as to break the former seal thereagainst. A fluid path is now opened past the sealing ring 28 and through fluid channel 44 to the nozzle 4 so that any air that remains trapped within the fluid chamber section 12 prior to the first use of the pump sprayer 1 will be expulsed to the atmosphere.

At the end of each priming stroke of trigger 8, the original seal between the sealing ring 28 and the centering post 40 of elbow 38 is once again established. The spring-like memory characteristic of the resilient spring section 14 will cause the spring section to release stored energy so that the combination spring and fluid chamber 10 will automatically return to the at rest configuration shown in FIG. 4. In this same regard, the trigger 8 is correspondingly driven back to its at rest position.

During the suction stroke of the trigger 8, the ball 36 will be lifted off its valve seat 22 to create a fluid path between the fluid supply of container 50 and the evacuated fluid chamber section 12 of the combination spring and fluid chamber 10 via the fill tube 52 so that the fluid chamber will be filled with fluid. During a subsequent dispensing stroke of the trigger 8, the increasing fluid pressure within the fluid chamber section 12 as it is compressed will force the ball 36 against its valve seat 22 and break the seal created by sealing ring 28 so as to complete the fluid path between the fluid chamber section 12 and the nozzle 4 via fluid channel 44. Therefore, fluid will be sprayed by pump sprayer 1 in the direction in which the nozzle is aimed by the user.

It may be appreciated that the combination dual action spring and fluid chamber 10 which has been described above enables the pump sprayer 1 to be manufactured with a single molded part to be housed within the shroud 6 between the fluid filled container 50 and the nozzle 4. By virtue of the integral connection of the expandable spring and collapsible fluid chamber sections 12 and 14 of combination 10, no metallic return springs, pistons or cylinders are required so that the total number of parts needed to manufacture the pump sprayer 1 can be advantageously reduced, in some cases, from thirteen to four in order to improve the efficiency and reduce the costs of manufacture.

I claim:

1. A trigger activated pump spray for attachment to a container having a supply of fluid, said pump sprayer comprising:

a shroud;

a cap closure coupled to said shroud and detachably connected to the container;

a nozzle to which some of the supply of fluid from the container is to be delivered;

a combination spring and fluid chamber housed within said shroud, said combination spring and fluid chamber including an expandable spring section and a collapsible fluid chamber section that are axially aligned with one another and separated by a space; and a trigger coupled to and rotatable within the shroud to engage said combination spring and fluid chamber at said space between said axially aligned spring and fluid chamber sections such that a rotation of said trigger causes said expandable spring section to be stretched and said collapsible fluid chamber section to be compressed to thereby open a fluid path between said fluid chamber section and said nozzle.

2. The trigger activated pump sprayer recited in claim 1, wherein said combination spring and fluid chamber is manufactured from a resilient rubber material having a spring memory so as to be adapted to store and release energy in response to a rotation of the trigger.

3. The trigger activated pump sprayer recited in claim 1, wherein each of said expandable spring section and said collapsible fluid chamber section of said combination spring and fluid chamber has a helically shaped body to facilitate said expandable spring section being stretched and said collapsible fluid chamber section being compressed.

4. The trigger activated pump sprayer recited in claim 1, wherein said combination spring and fluid chamber also includes a tube socket extending within said expandable spring section, said pump sprayer further comprising a fill tube engaged by said tube socket and communicating with the supply of fluid from the container.

5. The trigger activated pump sprayer recited in claim 1, further comprising first and second ledges extending around said combination spring and fluid chamber in spaced alignment with one another to establish said space between said axially aligned spring and fluid chamber sections, said trigger being received within said space between said first and second ledges so that a rotation of said trigger causes said expandable spring section to be stretched and said collapsible fluid chamber section to be compressed.

6. The trigger activated pump sprayer recited in claim 1, further comprising an elbow extending within said shroud and bending to form a coupling post for receipt by the collapsible fluid chamber section of said combination spring and fluid chamber to hold said combination within said shroud.

7. The trigger activated pump sprayer recited in claim 1, further comprising a base surrounding said expandable spring section of said combination spring and fluid chamber, said cap closure detachably connected to the container for holding said base against the container to prevent a displacement of said combination within said shroud.

8. The trigger activated pump sprayer recited in claim 1, wherein said combination spring and fluid chamber is manufactured from a single piece of resilient material with said collapsible fluid chamber section axially aligned with and separated from said expandable spring section by said space.

9. The trigger activated pump sprayer recited in claim 1, further comprising a vent hole formed through the expandable spring section of said combination spring and fluid chamber, said vent hole opening an air path between the container and the atmosphere when said trigger is rotated and said expandable spring section is stretched.

10. The trigger activated pump sprayer recited in claim 4, further comprising a valve seat formed within said tube socket and a ball seated upon and movable off said valve seat to control the delivery of the supply of fluid from the container to said nozzle.

11. The trigger assembly recited in claim 6, further comprising a flexible sealing ring surrounding the fluid chamber section and engaging said coupling post of said elbow to close the fluid path between said fluid chamber section and said nozzle, said trigger being rotated and said collapsible fluid chamber section being compressed to cause said sealing ring to disengage from said coupling post and thereby open said fluid path between said fluid chamber section and said nozzle.

12. The trigger activated pump sprayer recited in claim 6, further comprising a rim surrounding said fluid chamber section of said combination spring and fluid chamber, said elbow having a lip depending therefrom and engaging said rim of said fluid chamber section to hold said combination within said shroud.

13. The trigger activated pump sprayer recited in claim 10, further comprising a tab projecting across said tube socket above said valve seat to limit the movement of said ball off said valve seat.

14. A trigger activated pump sprayer for attachment to a container having a supply of fluid, said pump sprayer comprising:

a shroud;

a cap closure coupled to said shroud and detachably connected to the container;

a nozzle to which some of the supply of fluid from the container is to be delivered;

a one piece combination spring and fluid chamber housed within said shroud and manufactured from a resilient material having a spring memory, said combination spring and fluid chamber including an expandable spring section coupled to and axially aligned with a collapsible fluid chamber section;

a fluid path extending between said collapsible fluid chamber section and said nozzle and a seal extending across and closing said fluid path; and a trigger coupled to and rotatable within the shroud to engage said combination spring and fluid chamber, such the rotation of said trigger causes said expandable spring section to be stretched and said collapsible fluid chamber section to be compressed to increase the pressure within said fluid chamber section to thereby cause said seal to be broken and said fluid path to be opened between said fluid chamber section and said nozzle.

15. The trigger activated pump sprayer recited in claim 14, further comprising a vent hole formed through the expandable spring section of said combination spring and fluid chamber, said vent hole opening an air path between the container and the atmosphere when said trigger is rotated and said expandable spring section is stretched.

16. The trigger activated pump sprayer recited in claim 14, wherein said expandable spring section is axially aligned with and separated from said collapsible fluid chamber section by a space, said trigger being received within said space, such that a rotation of said spring causes said expandable spring section to be stretched and said collapsible fluid chamber section to be compressed.

17. A trigger activated pump sprayer for attachment to a container having a supply of fluid, said pump sprayer comprising:

a shroud;

a cap closure coupled to said shroud and detachably connected to the container;

a nozzle to which some of the supply of fluid from the container is to be delivered;

a combination spring and fluid chamber housed within said shroud, said combination spring and fluid chamber including an expandable spring section and a collapsible fluid chamber section;

a tube socket aligned with said collapsible fluid chamber section;

a fill tube coupled to said tube socket and communicating with the supply of fluid from the container; and a trigger coupled to and rotatable within the shroud to engage said combination spring and fluid chamber such that a rotation of said trigger causes said expandable spring section to be stretched and said collapsible fluid chamber section to be compressed to thereby open a fluid path between said supply of fluid and said nozzle via said fill tube and said fluid chamber section.

18. The trigger activated pump sprayer recited in claim 17, further comprising a valve seat formed within said tube socket and a ball seated upon and movable off said valve seat to control the delivery of the supply of fluid from the container to said nozzle by way of said fluid path.

19. The trigger activated pump sprayer recited in claim 17, further comprising a tab projecting across said tube socket above said valve seat to limit the movement of said ball off said valve seat.

20. The trigger activated pump sprayer recited in claim 17, wherein said expandable spring section is axially aligned with and separated from said collapsible fluid chamber section by a space, said trigger being received within said space, such that a rotation of said trigger causes said expandable spring section to be stretched and said collapsible fluid chamber section to be compressed.

* * * * *